US005720376A

United States Patent [19]

Polidoro et al.

[11] Patent Number: 5,720,376

[45] Date of Patent: Feb. 24, 1998

[54] DOCUMENT HANDLING SYSTEMS

[75] Inventors: Roberto Polidoro, Geneva, Switzerland; Andre Gerlier, Sciez, France

[73] Assignee: Mars Incorporated, McLean, Va.

[21] Appl. No.: 619,707

[22] PCT Filed: Sep. 29, 1994

[86] PCT No.: PCT/IB94/00395

§ 371 Date: Jun. 18, 1996

§ 102(e) Date: Jun. 18, 1996

[87] PCT Pub. No.: WO95/09407

PCT Pub. Date: Apr. 6, 1995

[30] Foreign Application Priority Data

Sep. 30, 1993 [GB] United Kingdom ..... 9320190

[51] Int. Cl.[6] ..... G07D 7/00

[52] U.S. Cl. ..... 194/207; 250/556; 356/71

[58] Field of Search ..... 194/206, 207; 250/556; 356/71

[56] References Cited

U.S. PATENT DOCUMENTS

| | | | |
|---|---|---|---|
| 4,583,398 | 4/1986 | Mitzel et al. | 73/156 |
| 4,669,380 | 6/1987 | Seib et al. | 101/216 |
| 4,807,735 | 2/1989 | Huber | 193/35 B |
| 5,004,898 | 4/1991 | Ihsikawa et al. | 235/475 |
| 5,014,325 | 5/1991 | Moritomo | 382/7 |

FOREIGN PATENT DOCUMENTS

| | | | |
|---|---|---|---|
| 0 110 264 | 6/1984 | European Pat. Off. | G07D 7/00 |
| 528717 | 11/1940 | United Kingdom | G07D 7/00 |
| 1162043 | 8/1969 | United Kingdom | F16C 13/00 |
| 2090685 | 7/1982 | United Kingdom | G07B 11/00 |
| 2107911 | 5/1983 | United Kingdom | G07D 7/00 |
| 2258332 | 2/1993 | United Kingdom | G06K 7/01 |
| 92/18953 | 10/1992 | WIPO | G07F 7/04 |

*Primary Examiner*—F. J. Bartuska
*Attorney, Agent, or Firm*—Fish & Richardson P.C.

[57] ABSTRACT

A banknote (9) inserted by a user in an entrance channel (1) of a banknote validator moves along a transport path defined by upper and lower belts (10 and 11) past two sensors (2). Each belt is supported on a respective support member (6, 7). The belts are driven on respective rollers (12, 13) which are rotatable on respective axles (14, 15). Projections (21, 20) or the support members bear on the axles (15, 14) against the action of springs (19, 18) such that the lower belt (11), in the region of the first sensor (2), is located at a predetermined distance from the first sensor and that the upper belt (10), in the region of the second sensor (2), is located at a predetermined spacing from the second sensor (2), thus causing the inserted banknote (9) to pass the sensors (2) at a predetermined spacing therefrom. Reference surfaces are similarly mounted. A support for the axles is described in which one end of the axle is axially movable relative to the support. An electrical contact is also described for making an electrical connection between elements on the supports when the supports are in the operative position.

21 Claims, 6 Drawing Sheets

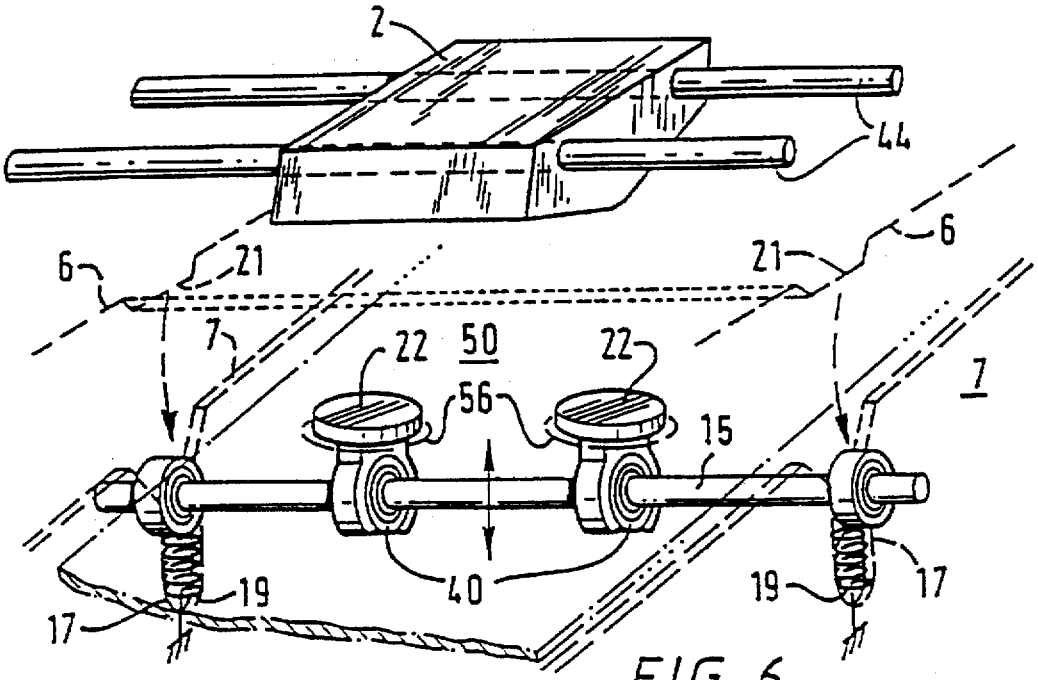
FIG. 6
FIG. 7
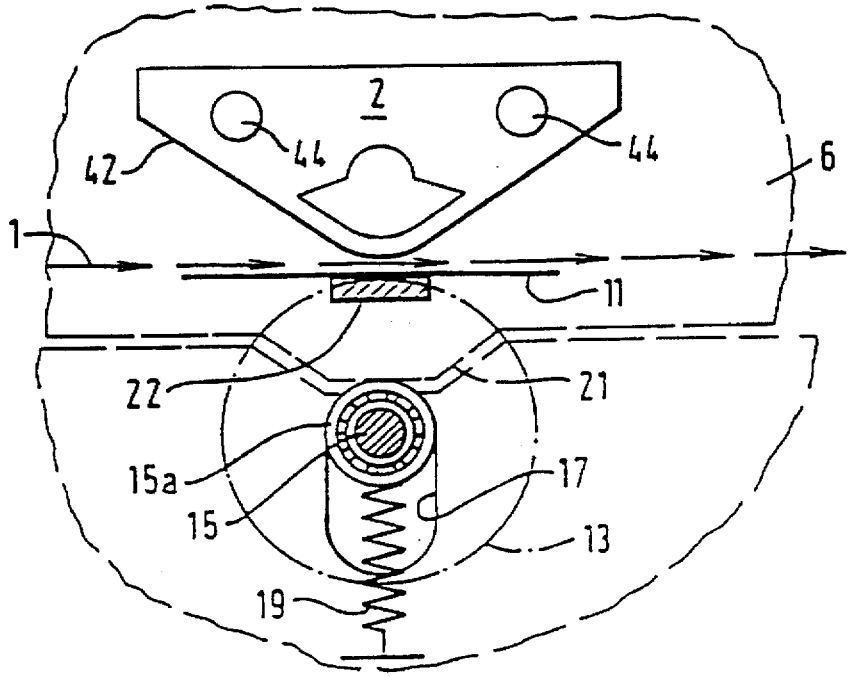

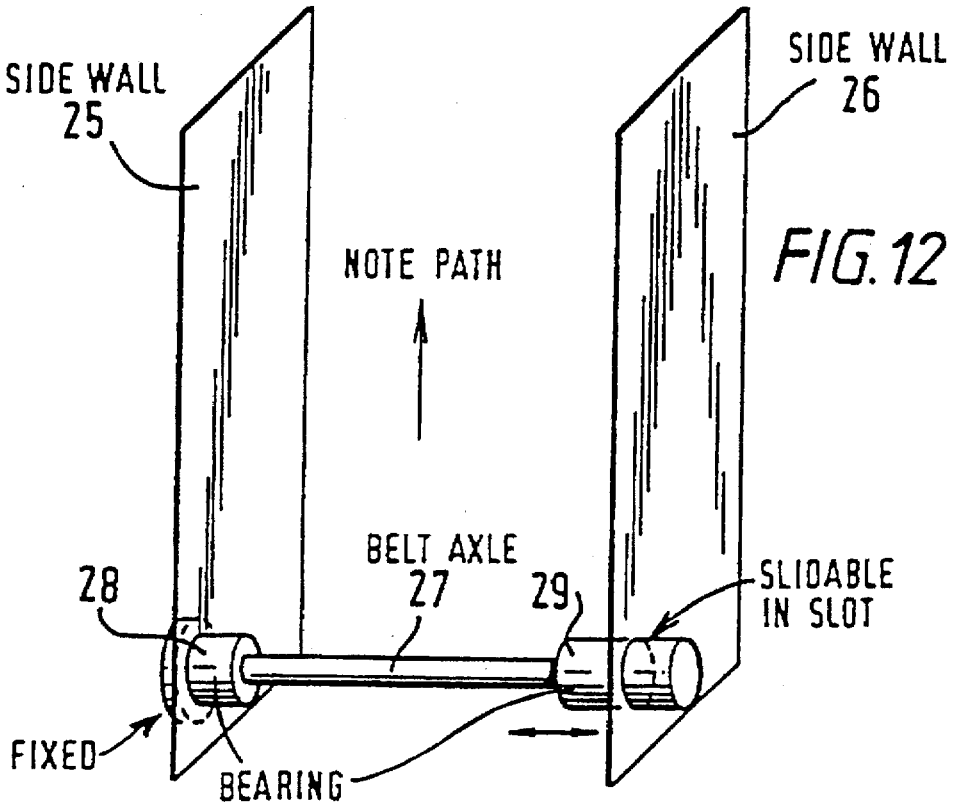
FIG. 12
FIG. 13
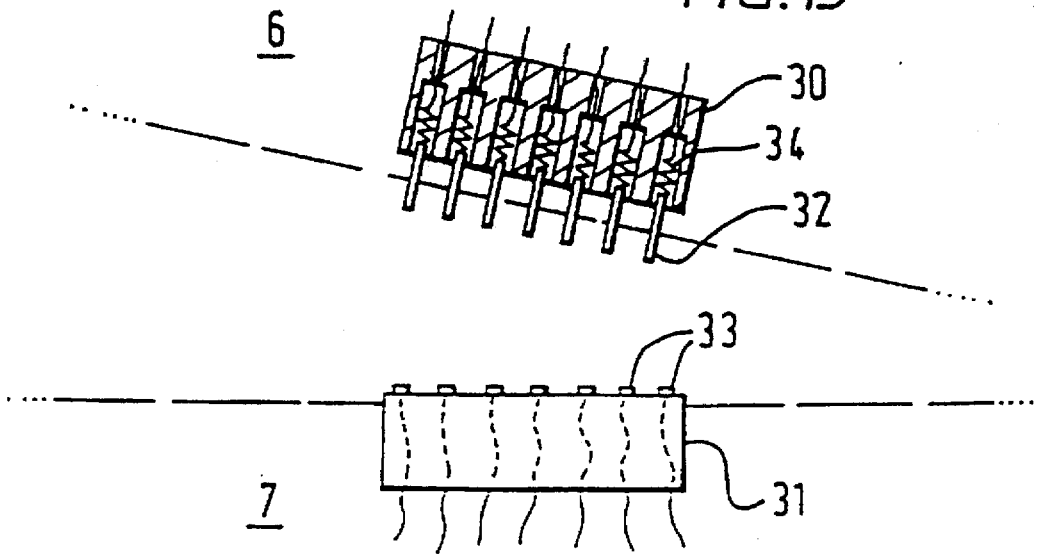

DOCUMENT HANDLING SYSTEMS

BACKGROUND OF THE INVENTION

The present invention relates to document handling systems such as banknote transport mechanisms, and in particular to transport mechanisms used in banknote validators, and to banknote validators incorporating such banknote transport mechanisms.

The term "banknote" as used throughout this specification, is intended to mean any document of value, such as a cheque, bond, credit card or bank card.

A banknote validator is shown in FIGS. 1 and 2. In operation, a user inserts a banknote into the entrance channel 1. The banknote is then transported by a transport mechanism past a sensor device 2. The output of the sensor device is used to determine whether the inserted banknote is genuine and of the appropriate denomination for the particular validator. A positive validation causes the inserted banknote to travel to a banknote stacker 3. A negative validation causes the banknote to be conveyed to a reject passage, where the banknote is returned no the user. The determination of whether the banknote is to be accepted by the validator is effected by validation circuitry 5 which operates in response to the output of the sensor device 2.

The transport path of the banknote from the entrance channel 1 past the sensor 2 is defined by a first, upper, support member 6 and a second, lower, support member 7. The first and second support members are arranged to pivot about an axis 8, which enables the support members to be separated, thereby facilitating various maintenance and servicing operations.

One problem with such validators is that, for accurate sensing to take place, the banknote must be positioned correctly with respect to the sensor 2. The pivoting arrangement of upper and lower support members gives rise to slight differences in positioning of the belts of the transport system, resulting in the spacing between the sensor and the banknote not being accurately reproduceable. It would therefore be desirable to provide an arrangement which overcomes this problem. In some sensing arrangements, a reference surface is provided at the position which would be adopted by a banknote being validated, for the purpose of calibrating the sensor output. As with the desirability for correct positioning of the banknote with respect to the sensor, it would also be desirable to arrange for the reference surface to be positioned at a constant and reproduceable distance from the sensor.

Furthermore, the width of the banknote passage must necessarily be somewhat greater than the width of the largest banknote which the validator is designed to accept, and, consequently, the lateral positioning of the banknote will not necessarily be well defined. It would therefore be desirable to provide an arrangement wherein all banknotes are caused to be transported such that they adopt a substantially constant lateral positioning within the banknote transport path.

Reference is made to GB-A-2107911 which describes a microprocessor controlled currency note validator which includes a transport for propelling an inserted note longitudinally past an optical scanning station. Infrared and visible color reflectance readings and opacity readings are taken along several longitudinally extending tracks on the note. The microprocessor normalises the reflectance readings to accommodate for variations in soiling and compares the normalized reflectance readings and the opacity readings against stored acceptance band data, correcting for pattern registration variations if necessary. The length of the note is also checked and a validation signal is provided if the note passes the optical tests and the length test. During the idle cycle, the microprocessor automatically adjusts the optical circuitry to compensate for component drift and dirt buildup.

Reference is also made to GB-A-2090685 which describes a ticket transport which is capable of rapidly reciprocating a ticket to permit a single transducer to read, write and/or verify information on The ticket. Upper and lower ticket guide plates define a ticket channel through which a ticket is propelled past an adjacent transducer by a plurality of rollers driven by a stepper motor. The upper ticket guide plate is hingedly mounted to permit access to the ticket channel. The stepper motor is controlled by special circuitry adapted to overcome the inductive time constant of the stepper motor to permit rapid acceleration, for example 0 to 50 inches per second in 30 milliseconds, of the ticket with minimum power dissipation. Sensors in the transport provide ticket position information. A combined magnetic head and pressure shoe assembly is provided for adjusting the thickness of the ticket channel.

SUMMARY OF THE INVENTION

In accordance with a first aspect of the present invention there is provided a banknote validator comprising first and second support members defining therebetween a banknote transportation path, and being separable about said path, an optical sensor carried by the first support member for sending a banknote, and a surface carried by the second support member, characterised in that the working distance between the optical sensor and the surface is maintained at a fixed distance by a mechanical linkage between the two support members comprising a projection of fixed length carried by the first support member and bias means carried by the second support member, such that when the two support members are brought together, the projection acts against the bias means, thereby adjusting the distance between the initial sensor and the surface.

The surface may be a transport surface, such as the surface of a roller or transport belt, for transporting the banknote in the note path. With such an arrangement, it will be appreciated that the substantially constant separation achieved between the sensor and the banknote enables better discrimination between genuine and counterfeit banknotes, and this arrangement is particularly desirable in validators having optical sensors incorporating one or more lenses, and/or in which the incident and reflected beams are oriented significantly away from the normal to the banknote surface, such as, for example, 45°. In such cases the spacing between the sensor and the banknote may be critical.

The surface could also be an optical reference surface associated with the optical sensor. In such an arrangement, it will be appreciated that the substantially constant separation between the sensor and the reference surface facilitates a more reliable calibration of the sensor.

In a closely relaxed second aspect, the invention provides a banknote validator comprising first and second support members defining therebetween a banknote transportation path, and being separable about said path, first means carried on one side of the path by the first support member, and second means carried on the other side of the path by the second support member, one of the first and second means being an optical sensor for sensing a banknote, and the other being a surface associated with the optical sensor, characterised in that the working distance between the first and second means is maintained ax a fixed distance by a mechanical linkage between the two support members comprising a spacer element of the fixed length and bias means, such that when the two support members are brought together, the spacer element acts against the bias means, thereby adjusting the distance between the first and second means.

In accordance with a third aspect of the present invention there is provided a banknote handling mechanism comprising at least one belt arranged to be driven on a roller member rotatable on an axle supported between first and second side walls, means for retaining said axle within said first side walls so as substantially to inhibit longitudinal movement of said axle and characterised by means for retaining said axle in said second side walls so as to permit longitudinal movement of said axle such that said axle remains at a substantially constant position relative to said first side wall.

It will be appreciated that, with such arrangement, documents, such as banknotes, being transported are not caused no move laterally as result of movement of the axle along its axis.

In accordance with a fourth aspect of the present invention there is provided a banknote handler of the type having a transport path defined by first second support members which are arranged to pivot about an axis so as to adopt selectively an operative mode, in which said support members are adjacent, and a non-operative mode, in which the support members are spaced apart thereby to enable a maintenance operation to be performed, characterised in that said first and second support members each have an electrical terminal member, the two terminal members being in electrical contact when said validator is in said operative mode and not otherwise.

This arrangement provides an advantageous feature in comparison with conventional devices, wherein sensors which are provided in the upper support member have connecting leads passing into the lower support member which must necessarily move each time the upper support member is pivoted away from the lower support member, thereby causing wear in the leads.

In order that the invention will be fully appreciated, non-limiting embodiments of the present invention will now be described with reference to the accompanying drawings.

BRIEF DESCRIPTION OF THE DRAWINGS

FIGS. 6 and 7 are schematic illustrations showing a combination of the above embodiments;

FIG. 12 is a schematic representation of a third embodiment of the present invention; and FIG. 13 is a schematic representation of a fourth embodiment of the present invention.

DESCRIPTION OF THE PREFERRED EMBODIMENTS

Figure 1:
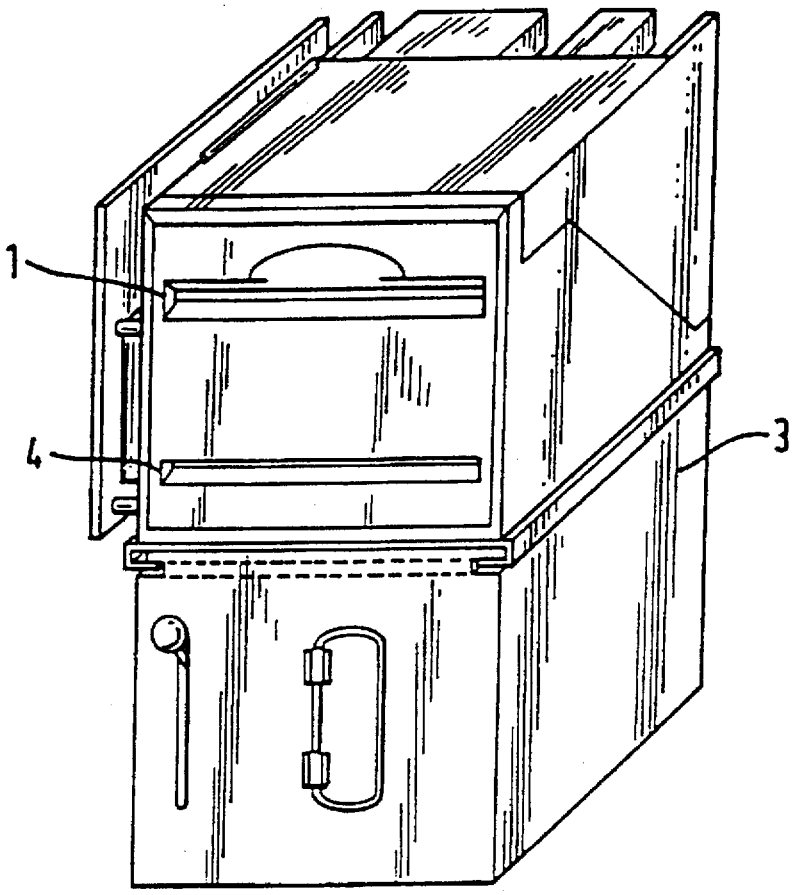
FIG. 1 shows the exterior of a conventional banknote validator.
Figure 2:
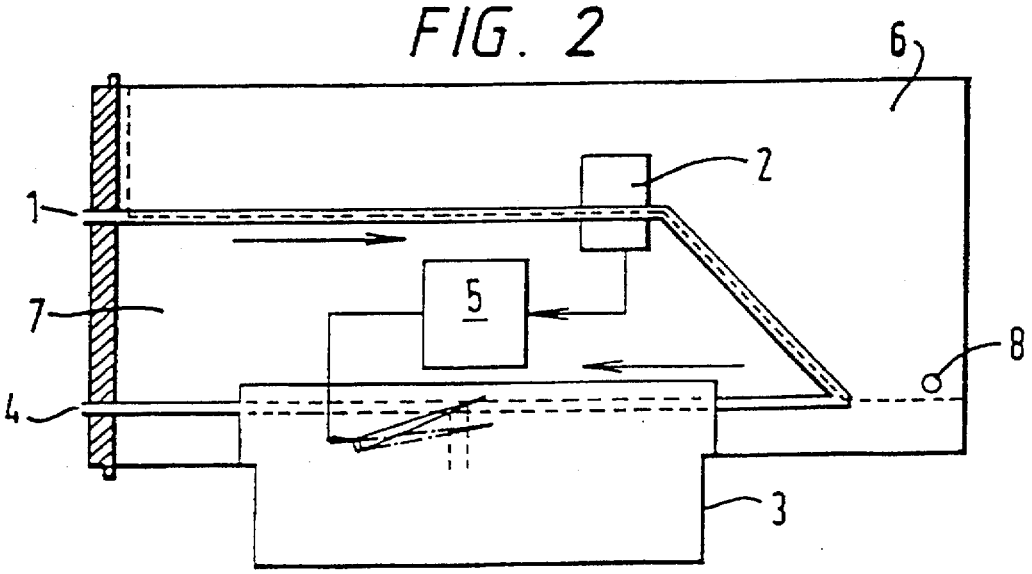
FIG. 2 shows in schematic form the conventional banknote validator of FIG. 1.
Figure 3:
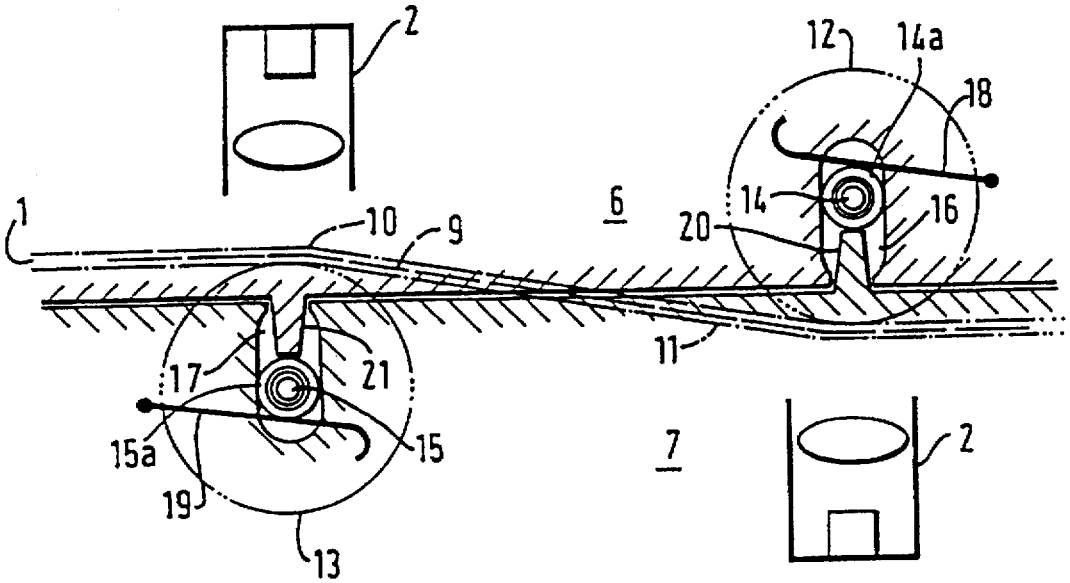
FIG. 3 is a schematic representation of a preferred embodiment of the present invention, showing the upper and lower support members in their closed position.

The banknote transport mechanism shown in FIG. 3 comprises an entrance channel 1 in which a banknote 9 has been inserted. The transport path of the banknote is defined by an upper belt 10 and a lower belt 11. The upper belt 10 is guided on a series of rollers, one of which is an upper roller 12. Similarly, the lower belt is driven on a series of rollers, one of which is a lower roller 13.

The upper belt 10 is supported on an upper support member 6, and the lower belt 11 is supported on a lower support member 7.

The upper and lower rollers 12 and 13 are each arranged to rotate on respective upper and lower axles 14 and 15 mounted in bearings **14*a* and 15*a* which are constrained to move within respective slots 16 and 17**.

An upper spring 18 is arranged to contact the bearing **14*a* to bias the upper axle 14 towards the lower support member 7, and a lower spring 19 is correspondingly arranged to contact the bearing 15*a* to bias the lower axle 15 towards the upper support member 6. The lower support member 7 is provided with a projection 20 on each side of the transport path which bears on the upper bearing 14*a* and thus on the upper axle 14, thereby to retain the upper roller 12 at a constant distance from the lower support member 7. Equally, the upper support member 6 is provided with a projection 21 on each side of the transport path which bears on the lower bearing 15*a* and thus on the lower axle 15 which serves to retain the lower roller 13 at a constant distance from the upper support member 6**.

It will be appreciated that, since the banknote 9 is constrained to rest against the lower belt 11 during passage past the first sensor 2, i.e. the one shown on the left-hand side of FIG. 3, the banknote 9 will be spaced from the first sensor 2 by a predetermined amount. Thus, this spacing will not be affected by the relative position of the upper and lower support members 6 and 7.

Equally, when the banknote 9 passes the second sensor 2, i.e. the one shown on the right-hand side of FIG. 3, the banknote 9 will be spaced from this sensor 2 by a predetermined amount, since the banknote 9 will be constrained to rest against the upper belt 10 which itself is driven on the upper roller 12. Since each sensor 2 incorporates a lens, the spacing between the banknote and the sensors is critical.

The arrangement shown incorporates two sensor devices 2, and this has the advantage that validation can take place on the basis of optical information received from both faces of an inserted banknote 9. Furthermore, the circuitry 5 is so arranged as to enable a user to insert a banknote in any of the four possible ways.

Alternatively, it would of course be possible to provide merely a single sensor.

Although both the upper and lower belts 10 and 1 are shown as extending past both rollers 12 and 13, it would of course be possible to provide a multiple belt arrangement, wherein the lower belt extends only around the lower roller 13, and the upper belt 10 extends only around the upper roller 12, with appropriate additional belts being provided to define the complete transport path for the banknote 9.

Figure 4:
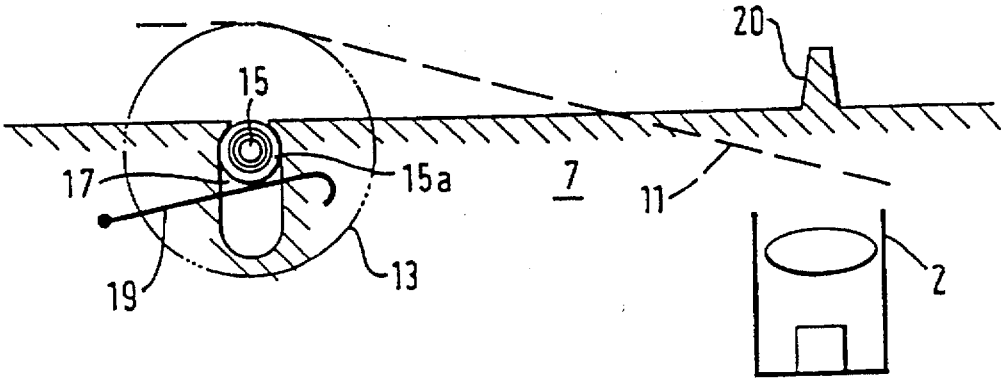
FIG. 4 shows the lower support member of the arrangement of FIG. 3, but in the open position.
Figure 5:
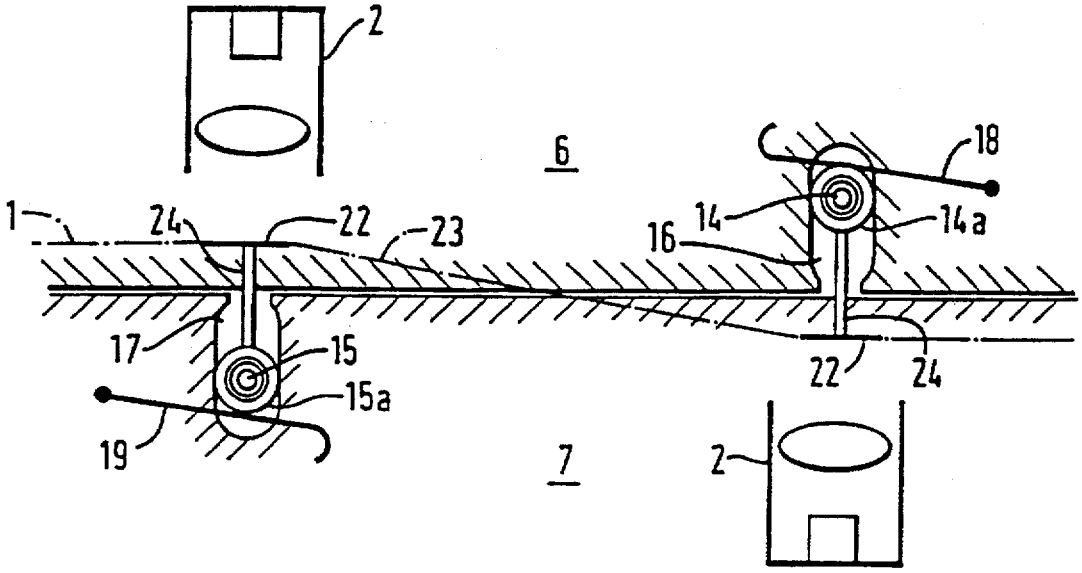
FIG. 5 is a schematic representation of a second embodiment of the present invention in which reference surfaces are provided for the sensors.
Figure 9:
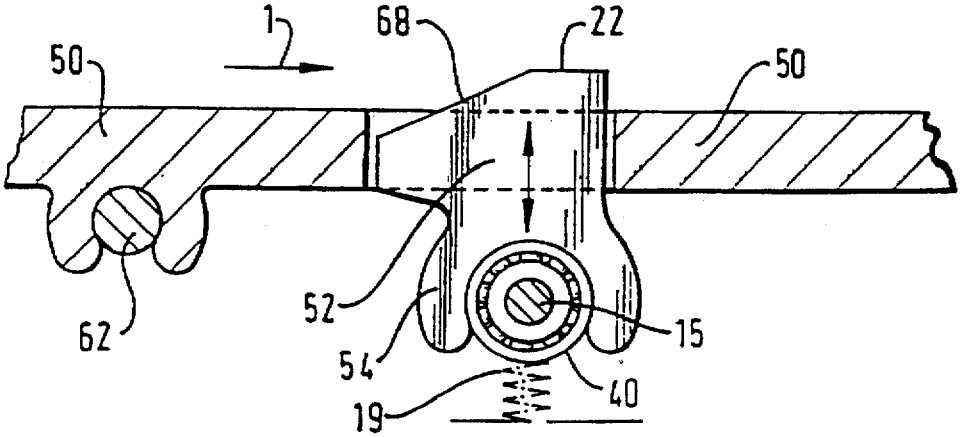
FIGS. 8, 9, 10 and 11 are schematic illustrations of various arrangements for supporting the reference surfaces.

FIG. 5 shows a second embodiment of the present invention, in which the same reference numerals are used as in FIGS. 3 and 4 to relate to the same features. So called "reference" surfaces 22 having predetermined characteristics are provided within the transport path 23 of the banknote which can enable calibration of the sensors in a known manner. The reference surface 22 shown on the left-hand side of FIG. 5 is supported on the lower axle 15 by means of a support element 24. As in the arrangement shown in FIGS. 3 and 4, a lower spring 19 bears on the lower axle 15 through its bearing (not shown) so as to bias the reference surface 22 toward the associated sensor 2. A projection forming part of the upper support member 6 is provided on each side of the transport path and bears on the lower axle 15 through its bearing so as to retain the axle at a constant separation from the upper support member 6. Since the sensor 2 is rigidly connected to the upper support member 6, this results in the reference surface 22 being positioned, when the validator is in the operative mode, at a constant separation from the sensor 2. A further, similar, reference surface 22 is provided, as shown on the right-hand side of FIG. 5, but which, in this case, is supported by the upper support member 6 and retained at a constant separation from the sensor 2 provided in the lower support member 7 by means of projections on the lower support member 7 which are the same as shown in FIGS. 3 and 4.

Although the arrangement shown in FIG. 5 has been described as an independent embodiment, it would be preferable to combine the features of this embodiment with those of the embodiment shown in FIGS. 3 and 4.

FIGS. 6 and 7 illustrate an advantageous arrangement in which a reference surface 22 is mounted on the axle for each roller described in the first embodiment. For clarity, only one axle 15 is illustrated, and this axle carries two reference surfaces 22 for one of the sensors 2. The reference surfaces 22 are coupled to the axle by means of bearings 40 which isolate the reference surfaces 22 from the rotation of the axle 15. As best seen in FIG. 7, in this embodiment, it is desired that the uppermost portion of the surface of the roller 13 and the reference surface are generally in the same plane, and that this plane lies at, or adjacent, the plane of the path 1 of the document. FIG. 7 also shows an advantageous mounting for the sensor 2 in which a casing 42 for the sensor is carried on two fixed shafts 44 mounted to the upper support 6. It will be appreciated that FIG. 7 is a schematic side view, and the spring 19 is shown schematically as a compression spring, although any suitable form of spring, such as a cantilever spring or pivotting spring, may be used as desired.

FIGS. 8, 9, 10 and 11 illustrate various alternative arrangements for mounting the support surfaces 22 relative to a platform 50 which is carried by the lower support 7, and acts as a wall to separate the transport path of a document from the remainder of the mechanism in the lower support (the platform 50 is also illustrated in FIG. 6). The reference surface 22 in these figures corresponds to the surface 22 to the left in FIG. 5, although it will be appreciated that similar arrangements may advantageously be used for mounting the other surface 22 shown to the right in FIG. 5 relative to a similar platform (or ceiling) carried by the upper support 6.

Figure 8:
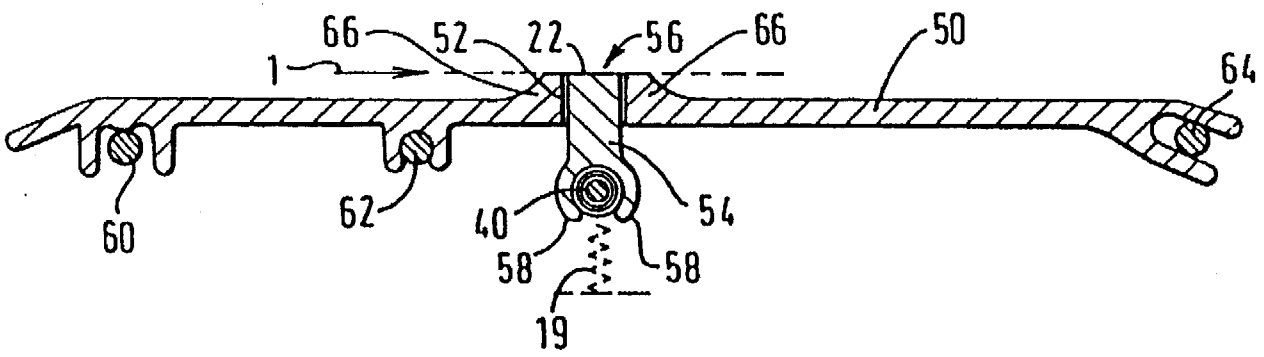

In FIG. 8, the reference surface 22 is carried by the stem 52 portion of a carrier 54. The stem portion 52 is generally slidable within an opening 56 through the platform. The lower portion of the carrier 54 is formed with lugs 58 which clip around the bearing 40. Such an arrangement provides support for the reference surface 22 independently of the platform 50. The platform 50 is held in position by three fixed axles 60, 62 and 64, the platform 50 being clipped to the centre axle 62. Therefore, the position of the reference surface 22 will be independent of any deformation, distortion or misalignment of the platform 50, and thus the position of the platform 50 is not critical. In FIG. 8, a spring 19 is illustrated (in phantom), although it will be appreciated that, in this embodiment, the springs 19 bear against the outermost bearings 15*a* of the axle 15.

The platform 50 is profiled with ramp surfaces 66 for guiding any unsupported portions of a document smoothly over the reference surface 22. However, with the arrangement in FIG. 8, the stem portion 52 of the carrier 54 might, in some situations, stand proud of the ramp surfaces 66 by a large amount, which would then result in an abrupt edge against which document might jam. In such a case, the arrangement shown in FIG. 9 may be used, in which the leading edge of the stem 52 is chamferred to define a lead-in ramp surface 68 to the reference surface 22.

Figure 10:
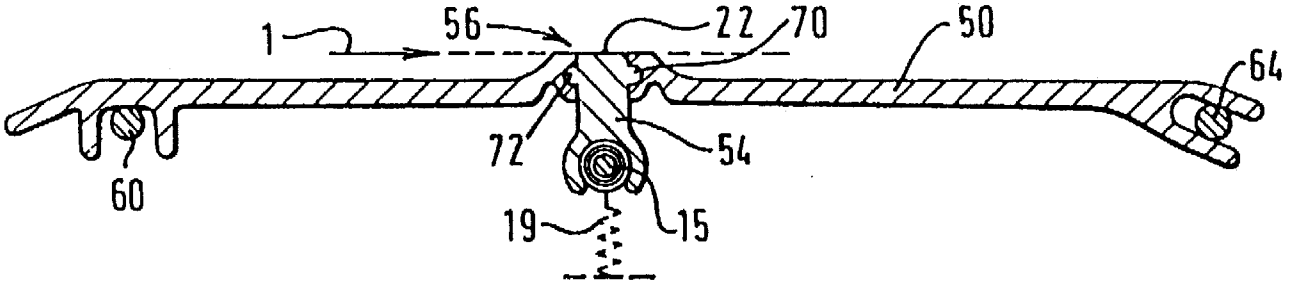

In the alternative arrangement shown in FIG. 10, the centre fixed axle 62 is omitted, and the central portion of the platform 50 is supported by being clipped to the stem 52 of the carrier 54. An annular projection 70 on the stem 52 is received in a complementary recess 72 formed in the periphery of the opening 56. Such an arrangement locates the reference surface 22 accurately relative to the platform 50 as well as relative to the sensor (not shown).

Figure 11:
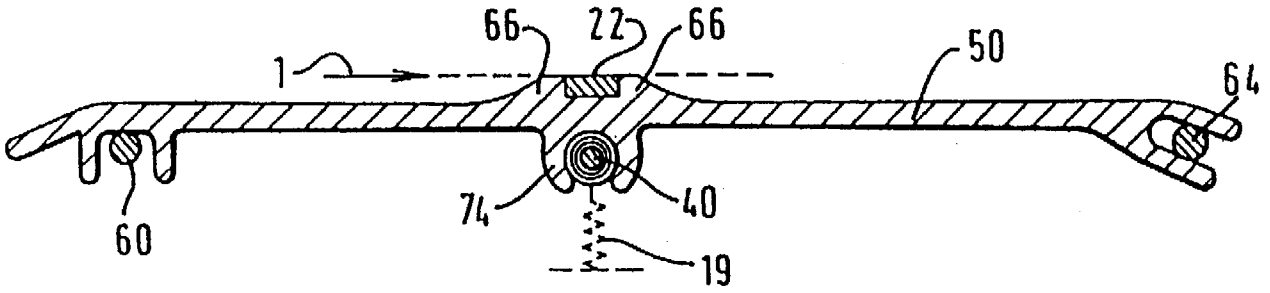

In FIG. 11, the carrier 54 is omitted, and the platform 50 is clipped at its centre directly to the bearing 40 by means of integral lugs 74 which depend from the platform 50. The reference surface 22 is mounted directly on the platform 50 in a recess between the ramp surfaces 66. With such an arrangement, although the reference surface 22 is mounted on the platform 50, the portion of the platform on which the reference surface is mounted is attached to the bearing 40 on the axle 13, and thus its relative position is controlled accurately.

It is believed that the arrangement in FIG. 11 might provide the simplest, convenient technique for supporting the reference surface and the platform at the predetermined position.

The arrangements described above use bearings 14*a*, 15*a* and 40 to avoid wear. However, it will be appreciated that the bearings may be omitted if desired, for example, if the shaft or axle supporting the reference surface 22 is not rotatable.

FIG. 12 shows a third embodiment of the present invention, wherein the transport path is defined by two side walls 25,26 in which axles (only one of which is shown in FIG. 5) are arranged, the axle 27 serving to support the transport system. The left-hand end of each axle 27, as viewed in FIG. 5, is located in a ball bearing race in the side wall 25 in such a manner that translational movement of each axle along its axis is prevented. In contrast, the right-hand end of the axle 27 is arranged in a corresponding ball bearing race in a slot in the side wall 26 which permits relative translational movement between each axle 27 and the side wall 26 so that, should there be slight variations in the spacing between the side walls 25 and 26 caused by, for example, vibrations or thermal expansion, each axle 27 will remain an a constant position in relation to side wall 25, thereby to enable banknotes to be guided along the transport path at a constant lateral spacing from the side wall 25. This is particularly desirable in banknote validators where the lateral position of the sensor in relation to the banknote should be reproduceable. However, it will be appreciated that such an arrangement is also beneficial in preventing jamming of banknotes.

The features of this embodiment could desirably be combined with those of one or more of the other embodiments described herein.

FIG. 13 shows a fourth embodiment of the present invention in which leads from a sensor (not shown) located in the upper support member 6 of the banknote validator terminate in an upper contact pad 30.

When the banknote validator is in its operational mode, with the upper support member adjacent a lower support member 7, the terminals 32 of the upper contact pad 30 establish electrical contact with corresponding terminals 33 of a lower contact pad 31 located within the lower support member 7.

The terminals 32 of the upper contact pad 30 are mounted on springs 34 such that, on pivoting the two support members 6 and 7 so as to adopt the operative mode, referred to above in relation to the first and second embodiments, the terminals 32 are retracted against the bias of the springs 34, and, since this retraction is substantially a translational movement, the pivotal movement of the support members gives rise to a degree of relative translational movement between the terminals 32 of the upper contact pad 30 and the terminals 33 of the lower contact pad 31, and this will cause the contact pads 30 and 31 to rub against each other to a small extent, thereby to clean the contact surfaces.

Although the arrangement shown in FIG. 13 has been described as an independent embodiment, it would be preferable to combine the features of this embodiment with those of one or more of the above-described embodiments.

Although the present invention has been described in relation to preferred embodiments, it will be appreciated that various modifications could be made without departing from the scope of the invention which is defined solely by the claims appended hereto. For example, although, in the first embodiment described above, each roller member is positioned at the same lateral position as its associated sensor, design constraints could render it desirable to provide a degree of longitudinal offset, provided that the resulting spacing between a banknote and the sensor is substantially constant. Furthermore, although roller members are provided in the preferred embodiment, which provide a well-defined position for the belts, it would alternatively be possible to arrange for the projections on the upper and lower support members to bear directly on the belts.

We claim:

1. A banknote validator comprising first and second support members defining therebetween a banknote transportation path, and being separable about said path, an optical sensor carried by the first support member for sensing a banknote, and a surface carried by the second support member, wherein the working distance between the optical sensor and the surface is maintained at a fixed distance by a mechanical linkage between the two support members comprising a projection of fixed length carried by the first support member and bias means carried by the second support member, such that when the two support members are brought together, the projection acts against the bias means, thereby adjusting the distance between the initial sensor and the surface.

2. A banknote validator according to claim 1, wherein the bias means acts to reduce the working distance between the optical sensor and said surface.

3. A banknote validator according to claim 2, wherein the optical sensor is, in use, fixed relative to the first support member, and the surface is movably mounted on the second support member and is biased towards the first support member by said bias means.

4. A banknote validator according to claim 3, wherein the surface mounted on the second support member is carried on a movable carrier member.

5. A banknote validator according to claim 4, wherein the spacer element engages the movable carrier member.

6. A banknote validator according to claim 4, wherein the biasing means acts on the carrier member.

7. A banknote validator according to claim 4, wherein the carrier member comprises a longitudinal axle, the end regions of the longitudinal axle being received in slots in the second support member to permit movement towards and away from the first support member.

8. A banknote validator according to claim 7, wherein the axle is rotatable.

9. A banknote validator according to claim 1 wherein the surface comprises an optical reference surface associated with the optical sensor.

10. A banknote validator according to claim 1 wherein the surface comprises a transport surface for transporting a banknote in the banknote path.

11. A banknote validator according to claim 1 wherein there are a plurality of said surfaces each at a predetermined respective spacing from the optical sensor, one surface being an optical reference surface and another being a transport surface for transporting a banknote in the banknote path.

12. A banknote validator according to claim 10 wherein the transport surface comprises a surface of a transportation belt.

13. A banknote validator according to claim 10 wherein the transport surface comprises a surface of a transportation roller.

14. A banknote validator according to claim 1 wherein the optical sensor is of a type which emits an incident beam inclined at an angle to the normal of the banknote surface, and receives a reflected beam inclined at a corresponding inclined reflection angle.

15. A banknote validator according to claim 1 wherein the support members are pivotably coupled.

16. A banknote validator according to claim 1 further comprising a second optical sensor mounted downstream of the first optical sensor, and carried by the opposite support member to the first optical sensor, a second surface carried by the opposite support member to the first surface, and a second mechanical linkage between the two support means for maintaining a fixed working distance between the second optical sensor and the second surface, said mechanical linkage and said second mechanical linkage being of substantially the same construction.

17. A banknote validator comprising first and second support members defining therebetween a banknote transportation path, and being separable about said path, first means carried on one side of the path by the first support member, and second means carried on the other side of the path by the second support member, one of the first and second means being an optical sensor for sensing a banknote, and the other being a surface associated with the optical sensor, wherein the working distance between the first and second means is maintained at a fixed distance by a mechanical linkage between the two support members comprising a spacer element of the fixed length and bias means, such that when the two support members are brought together, the spacer element acts against the bias means, thereby adjusting the distance between the first and second means.

18. A banknote validator according to claim 17, wherein the spacer element is carried on the first support member, and the bias means is carried on the second support member.

19. A banknote validator according to claim 17 wherein the bias means acts to reduce the working distance between the first and second means.

20. A banknote validator according to claim 17, wherein the first means is, in use, a fixed relative to the first support member, and the second means is movably mounted on the second support member and is biased towards the first support member by said bias means.

21. A banknote validator according to claim 17, wherein the first means is the optical sensor, and the second means is the surface.

* * * * *

UNITED STATES PATENT AND TRADEMARK OFFICE

CERTIFICATE OF CORRECTION

PATENT NO. : 5,720,376

DATED : February 24, 1998

INVENTOR(S) : Polidoro et al.

It is certified that error appears in the above-identified patent and that said Letters Patent is hereby corrected as shown below:

Title page, item

[86] cancel "PCT No.: PCT/IB94/00395" and insert --PCT No.: PCT/IB94/00305--.

Col. 2, line 8, cancel "The" and insert --the--.

Col. 2, line 66, cancel "ax" and insert --at--.

Col. 3, line 16, after "such", insert --an--.

Col. 3, line 18, cancel "no" and insert --to--.

Col. 3, line 22, after "first", insert --and--.

Col. 6, line 50, cancel "an" and insert --at--.

Signed and Sealed this

Sixteenth Day of February, 1999

*Attest:*

*Attesting Officer*

*Acting Commissioner of Patents and Trademarks*